United States Patent [19]

Vance

[11] Patent Number: 4,688,279

[45] Date of Patent: Aug. 25, 1987

[54] COMBINATION STRETCHER AND STAIRCHAIR

[75] Inventor: Ronald D. Vance, Wilmington, Ohio

[73] Assignee: Ferno-Washington, Inc., Wilmington, Ohio

[21] Appl. No.: 890,012

[22] Filed: Jul. 24, 1986

[51] Int. Cl.[4] ..... A61G 1/02

[52] U.S. Cl. ..... 5/82 R; 5/81 R; 296/20; 297/1

[58] Field of Search ..... 5/82 R, 81 R, 81 B, 5/86; 296/20; 297/1

[56] References Cited

U.S. PATENT DOCUMENTS

| | | | |
|---|---|---|---|
| 2,699,557 | 1/1955 | Gravatt | 5/82 R |
| 3,122,758 | 3/1964 | Ferneau | 5/82 R |
| 3,137,511 | 6/1964 | Weil et al. | 296/20 |

*Primary Examiner*—Alexander Grosz

*Attorney, Agent, or Firm*—Frost & Jacobs

[57] ABSTRACT

A combination stretcher and stairchair having a main frame mounting pivotal torso and leg rest sections which when elevated convert from a stretcher to form a stairchair, and in which the conversion from the stretcher position to the stairchair position is easily achieved by actuating a release bar, the stairchair being readily reconverted to a stretcher by collapsing sets of diagonal braces.

21 Claims, 7 Drawing Figures

COMBINATION STRETCHER AND STAIRCHAIR

BACKGROUND OF THE INVENTION

1. Field of the Invention

The present invention relates to emergency equipment, and in particular to a combination stretcher and stairchair adapted to support a human body in either prone or sitting positions. This invention further constitutes an improvement over U.S. Pat. No. 3,122,758, for "Combined Stretcher And Stairchair".

2. Description of the Prior Art

Combination stretchers and stairchairs have been in use for many years, the units being convertible from one position to the other by rearranging the frame parts and locking them in the desired position. Significant difficulties have been encountered with the combination stretchers and stairchairs currently in use. A major difficulty lies in the transition from one position to the other, which recuires manipulation of the various latches which are used to lock the frame parts in the selected position. Another problem has been in the ability of the attendants to easily grip and carry the stretcher when in its alternate positions of use. While carrying handles have been proposed, they have been in the nature of pivotal members which must be moved from one position to the other and locked in place. Another disadvantage of conventional stretcher chairs lies in the lack of firm ground support when in the chair position due to the fact that two of the stretcher wheels normally contact the ground and the remaining suoport is provided by a crossbar.

SUMMARY OF THE INVENTION

It is an object of the present invention to provide a combination stretcher and stairchair which is of simple construction and at the same time corrects the difficulties encountered with conventional stairchairs.

It is a further object of the present invention to provide a combination stretcher and stairchair having a simple and easily releasable mechanism to provide a smooth transition from one position of use to the other.

It is another object of the invention to provide a combination stretcher and stairchair having enhanced stability when in the stairchair position and which, in the stretcher position, is sufficiently firm and rigid to serve as a squad bench in the emercency vehicle.

Another object of the present invention is to provide a combination stretcher and stairchair which is easy to carry and which has a towing mechanism for use when in the stretcher position.

In accordance with the foregoing objectives, the present invention provides an improved combination stretcher and stairchair which is easily converted from one position to the other. To release the frame from the stretcher position all one must do is actuate a simple release bar. The release bar ends have U-shaped cutout portions which, when in the stretcher position, mate with pins attached to the joints of the diagonal braces which support the seat when in the chair position. When in the stretcher position, the diagonal braces are folded in half at the joints in such a way that the upper section of the diagonal braces lies directly on top of the lower section, the diagonal braces lying below the plane of the stretcher frame when in that position. By actuating the release bar, the U-shaped cutout portions move away from the pins resulting in the braces being released to unfold until they reach the unfolded straight position.

When in the chair position, the present invention is much more stable than those in the prior art. The chair sits firmly on four legs—not on wheels. In addition, the construction is such that the front legs are extendable and function as carrying handles, the front legs being arranged to automatically telescope into the chair forming frame members as the stretcher frame is moved to the upright chair position. The diagonal braces which support the frame members forming the chair seat have past dead center joints which add stability to the chair in that the seat cannot collapse when its braces are in the past dead center position. An advantage of these diagonal braces is that simple manual pressure is all that is necessary to release them, the braces folding at their midway joints so that the chair can be easily converted back into the stretcher position. Another advantage of these diagonal braces is that they provide a more natural seat height.

Finally, a tow bar is telescopically mounted on the frame to facilitate towing the unit when in the stretcher position. Once the tow bar is released from its storage position, it can be extended to a length comfortable for towing the stretcher. There is a spring mechanism within the tubular sleeve which houses the tow bar in its stored position and which houses a tow pin into an aperture in the tow bar to lock the bar in the extended position so that the tow bar will not come completely out. There is also a double swivel joint (universal) in the tow bar to permit multidirectional movement of the tow bar for easy towing.

DESCRIPTION OF THE PREFERRED EMBODIMENT

Figures 1, 2:
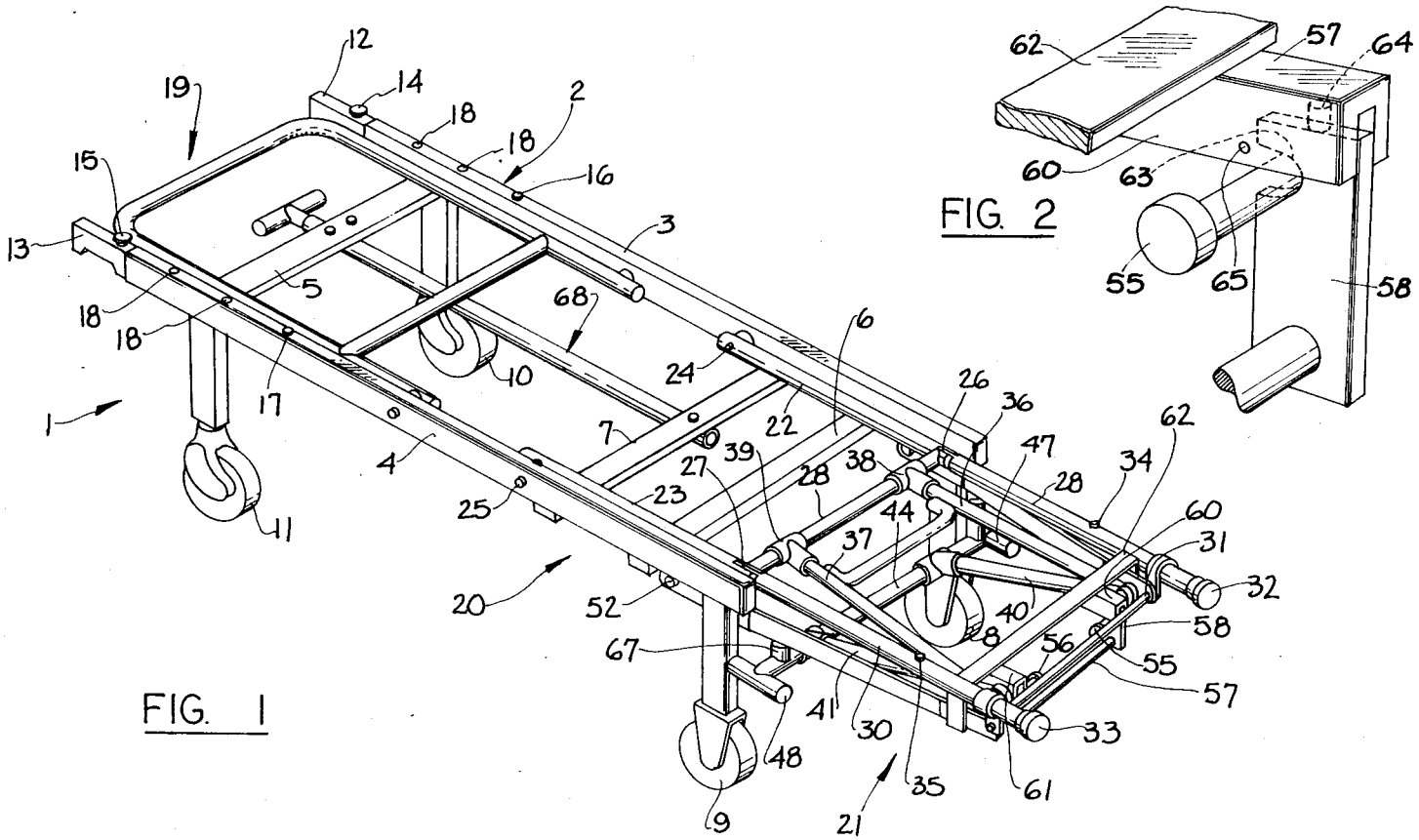
FIG. 1 is a perspective view of the invention in the stretcher position.
FIG. 2 is an enlarged fragmentary perspective view of the release, bar mechanism.

The combination stretcher and stairchair, generally designated 1, consists of a main frame 2 having side rails 3 and 4 interconnected by cross braces 5, 6, and 7 which form a rigid support for the patient. Wheeled legs 8, 9, 10, and 11 are provided at the corners of the main frame 2, the latter pair of wheels being caster wheels. Referring to FIG. 1 illustrating the invention in the stretcher position, extensible handles 12 and 13 are shown telescoped into the head ends of the side rails 3 and 4 of the main frame 2, the handles having latch buttons 14 and 15 interconnected with latch pins 16 and 17, respectively. The latch buttons 14 and 15 are attached to the latch pins 16 and 17. When the latch buttons are depressed, the latch pins 16 and 17 will recede within the side rails 3 and 4 to release the handles for movement into an extended position where they can be locked into place by allowing the latch pins to emerge through any of the latch holes 18 located on the side rails 3 and 4.

The main frame 2 is provided with a back and headrest section 19 which is pivotally secured to the side rails 3 and 4 intermediate their ends in conventional fashion, and while not shown, the back rest may be provided with conventional elevating means so that it may be raised and lowered relative to the main frame 2. It will be understood that the back and headrest section, as well as the torso and leg rest sections to be next described, will be covered with a suitable skin, such as aluminum sheeting, or with a fabric which provides support for the patient, such coverings being omitted to permit illustration of the structural features of the invention.

Figure 3:
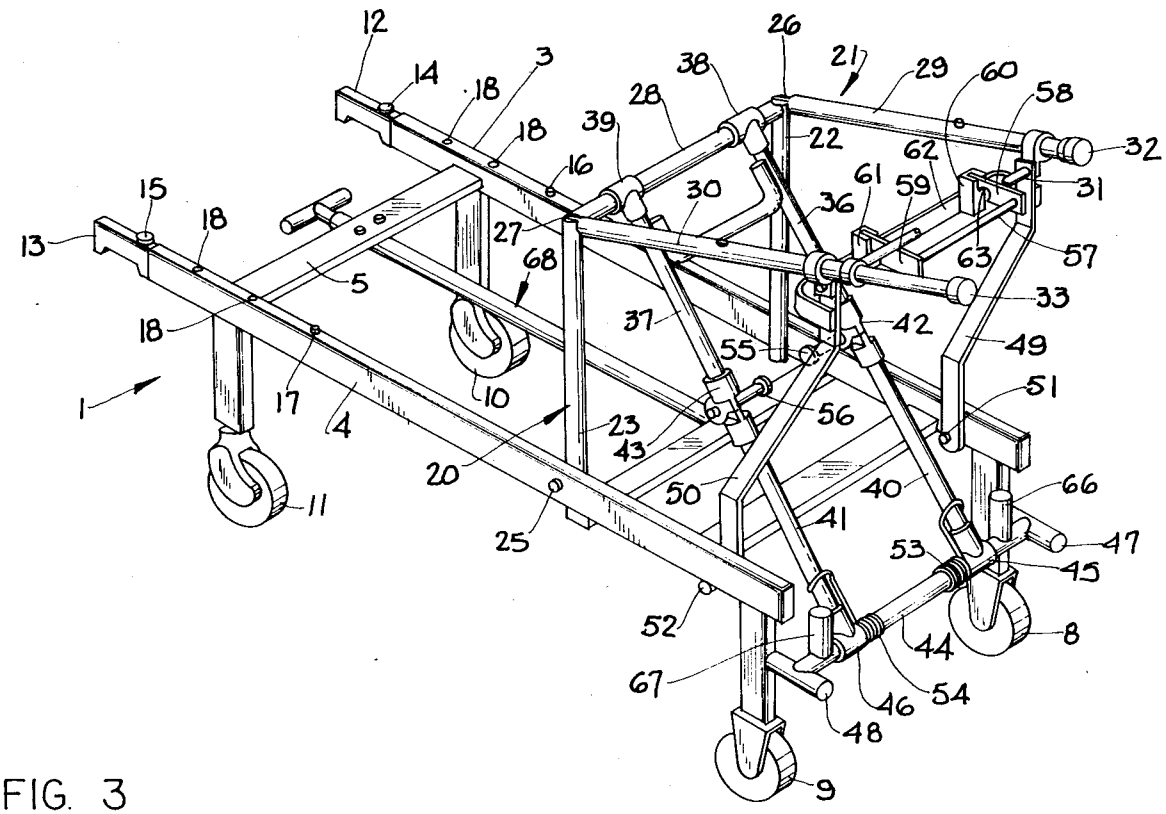
FIG. 3 is a perspective view of the invention in the stairchair position prior to being tilted to the vertical position, with the back and headrest section not shown.
Figure 4:
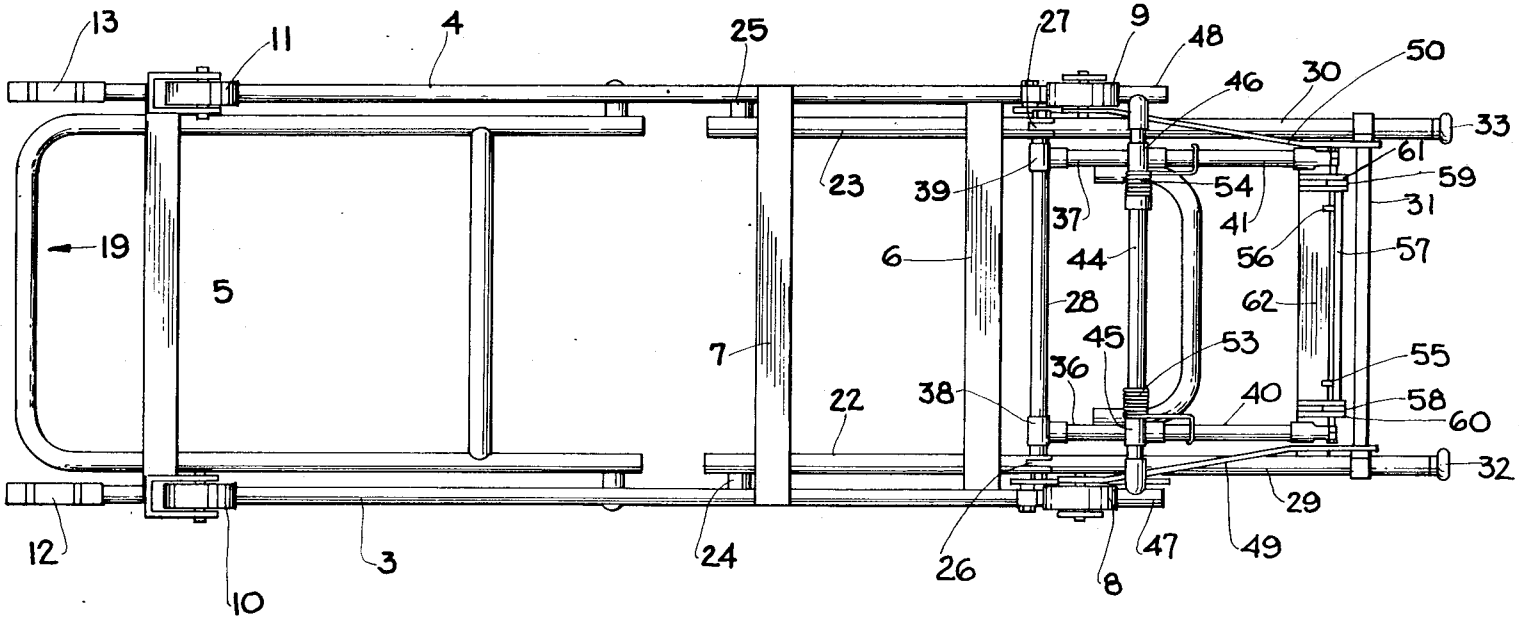
FIG. 4 is a bottom plan view of the invention in the stretcher position.

As seen in FIG. 3, the main frame is also provided with a torso section, indicated generally at 20, and a leg rest section indicated generally at 21, which are convertible to form a seat when in the stairchair position. The torso section comprises a pair of side frame members 22 and 23 which are pivotally mounted to the side rails 3 and 4, respectively, by pivot pins 24 and 25. At their opposite ends the side frames are connected to hinges 26 and 27 and through the hinges to a cross brace 28.

The leg rest section 21 comprises a pair of side frame members 29 and 30 which are secured at their inner ends to the hinges 26 and 27, respectively, and in the stretcher position extend in prolongation of the side frame members 22 and 23 of the torso section, as seen in FIG. 1. A cross brace 31 extends between the side frame members 29 and 30 adjacent their distal ends. At their distal ends the side frame members telescopically receive leg forming posts 32 and 33, respectively, which may be extended to form carrying handles, suitable latch buttons 34 and 35 being provided to secure the posts 32 and 33 in their retracted position. FIG. 3 shows post 32 in retracted position and post 33 in extended position.

As best seen in FIG. 3, the torso and leg rest sections are provided with a series of diagonal braces which raise and lower the torso and leg rest sections relative to the main frame. A first set of diagonal braces 36 and 37 are connected by T-fitting 38 and 39, respectively, to the cross brace 28. At their opposite ends the braces 36 and 37 are connected to a second set of diagonal braces 40 and 41 by means of hinges 42 and 43, respectively, which permit pivotal movement of the sets of braces from an extended position, as seen in FIG. 3, to a collapsed position, as seen in FIG. 1. At their opposite ends the braces 40 and 41 are pivotally connected to a crossbar 44 by means of T-fitting 45 and 46, the crossbar 44 being mounted on posts 47 and 48 projecting outwardly from the wheeled legs 8 and 9, respectively.

An additional pair of stabilizing braces 49 and 50 extend between the side rails 3 and 4 and the side frame members 29 and 30, respectively. The braces 49 and 50 are of angular configuration integrally connected to the side rails 3 and 4 by pivot pins 51 and 52, respectively, and to the side frame members 29 and 30 by means of cross brace 31, the opposite ends of which serve as pivot pins for the braces 49 and 50.

When the torso and leg rest sections are in the extended position shown in FIG. 3, the sets of diagonal braces 36, 40, and 37, 41 are effectivelv locked by the hinges 42 and 43, which lock in a past dead center position, the springs 53 and 54 urging the braces 40 and 41 and hence hinges 42 and 43 toward the past dead center position. The braces can be readily collapsed by manually moving the hinges in a collapsing direction, as by grasping the pins 55 and 56 which serve as pivots for the hinges 42 and 43 and also as locking pins for the torso and leg rest section when in the collapsed or stretcher position shown in FIG. 1. To this end, a release bar 57 is mounted on a pair of brackets 58 and 59 which are pivotally connected to slotted lugs 60 and 61, respectively, mounted on a strap 62 secured at its opposite ends to the braces 49 and 50. The brackets 58 and 59 are provided with notches, such as the notch 63 seen in FIG. 2, which engage the pins 55 and 56, respectively, when the torso and leg rest sections are in the collapsed or flattened position shown in FIG. 1, thereby locking the torso and leg rest sections in the collapsed condition. As seen in FIG. 2, a compression spring 64 is mounted in the lug 60 and positioned relative to the pivot pin 65 for the bracket 58 so as to bias the notch 63 in the direction of the pin 55. A similar spring (not shown) is provided in lug 61. When in the collapsed condition, the brackets 49 and 50 seat, respectively, on the short posts 66 and 67 which project upwardly from crossbar 44.

To convert the stretcher into the stairchair position, the release bar 57 is pulled outwardly in a direction parallel to and away from the stretcher frame, thereby pivoting the lugs 60 and 61 in a direction to release the engagement of the notches, such as notch 63, with the pins 55 and 56. The pairs of diagonal braces 36, 40 and 37, 41 are thus released for movement to the chair forming position.

Figure 6:
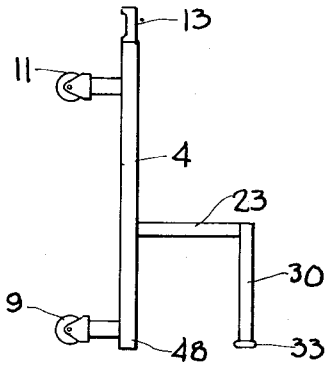
FIG. 6 is a schematic side elevational view of the invention in the stairchair position.

It may be noted that when in the stretcher chair position, as seen in FIG. 6, the unit is firmly seated on the posts 46 and 48 which form rear legs, and on the posts 32 and 33 which form front legs. If the unit is converted from the stretcher position of FIG. 5 to the chair position of FIG. 6 while the pasts 32 and 33 are extended, the posts will automatically retract when they come into contact with the ground and will lock in the retracted position.

Figure 5:
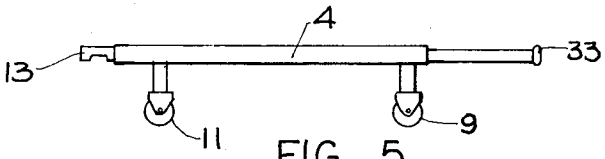
FIG. 5 is a schematic side elevational view of the invention in the stretcher position.
Figure 7:
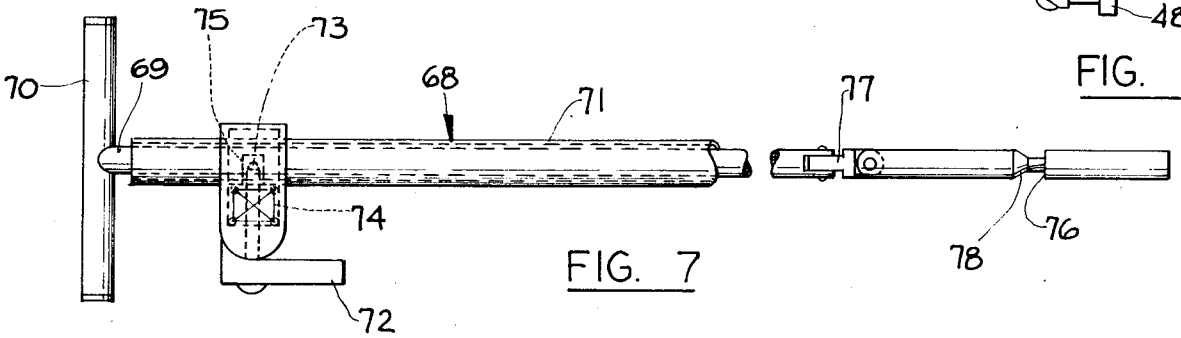
FIG. 7 is an enlarged top plan view with parts broken away of the tow bar mechanism.

When the unit is in the stretcher position of FIG. 5, it is freely movable on its four wheels. In order to facilitate rolling movement, the stretcher is equipped with a tow bar assembly 68 which, as seen in FIG. 7, comprises a tow bar 69 having a tow handle 70, the tow bar being stored telescoped within a tubular sleve 71 which is mounted on the underside of the cross braces 5 and 7. A locking mechanism retains the tow bar 69 within the sleeve 71 for storage. To release the tow bar from its stored position, a tow bar release 72 is rotated and displaced outwardly by a camming action, such movement of the release 72 resulting in the latch pin 73 being displaced outwardly and the spring 74 compressed. As the latch pin 73 moves outwardly it is freed from the aperture 75 in the tow bar 69 and the tow bar released. Once the tow bar is released, it may be pulled outwardly, the latch pin 73 sliding along the tow bar until it has reached the annular recess 76, the latch pin entering the recess under the influence of spring 74. The annular recess 76 prevents the tow bar 69 from being pulled completely out of the tubular sleeve 71 in normal use. A double swivel joint 77 permits multidirectional movement of the tow bar when in the fully extended position. When the tow bar is pushed back into the tubular sleeve 71 to reposition it in its stored position, the latch pin 73 will be cammed outwardly by the conical segment 78 which will displace the latch pin outwardly and hence release the tow bar for inward movement.

What is claimed is:

1. A combination stretcher and stairchair comprising:

a main frame having an opposing pair of side rails with spaced apart cross braces extending between said side rails, a torso section pivotally connected to said side rails intermediate their opposite ends, said torso section having opposing side frame members pivotally connected at their inner ends to said side rails, and a crossbar at their outermost ends, a leg rest section having opposing side rail members pivotally connected to the outermost ends of the side rails of said torso section, and a cross brace extending between the side rail members of said leg rest section adjacent their outermost ends, set of diagonal braces interconnecting said torso section and said main frame for pivotal movement of said torso and leg rest sections from a collapsed position in which the side frame members of said torso and leg rest sections are essentially planar with the side rails of said main frame, to an elevated position in which said sections form a seat, a first set of said diagonal braces being pivotally connected at one end to the cross brace at the outer ends of the side frame members of said torso section and pivotally connected at their opposite ends to the ends of a second set of said diagonal braces, the opposite ends of said second set of diagonal braces being pivotally connected to said main frame at one end thereof, said sets of diagonal braces extending in prolongation of each other when the torso and leg rest sections are in the elevated position, and lying at an acute angle to each other when the torso and leg rest sections are in the collapsed condition, and means for releasably locking the sections in both the collapsed and elevated positions.

2. The device of claim 1 wherein said device has four legs on which it firmly rests when in the elevated stairchair position.

3. The device of claim 2 wherein at least two of said legs are posts, each of which is telescoped within the side frame members of said leg rest section, and wherein said posts can be extended from said side frame members to function as carrying handles when the torso and leg rest sections are in the collapsed stretcher position.

4. The device of claim 3 wherein said posts automatically retract into said side frame members when said torso and leg rest sections are in the extended position and the posts are pressed into contact with the ground.

5. The device of claim 1 wherein said means for releasably locking the torso and leg rest sections in the collapsed position comprises a release bar.

6. The device of claim 5 wherein said release bar is mounted on a pair of brackets which are pivotally connected to a pair of slotted lugs fixedly secured relative to said leg rest section.

7. The device of claim 6 wherein each of said brackets has a notch dimensioned to engage a pin extending from the pivotal connection between said first and second sets of diagonal braces.

8. The device of claim 7 wherein each said lug mounts a compression spring positioned to bias said notches in the direction of said pins.

9. The device of claim 1 including pivotally mounted stabilizing braces extending between said main frame and the distal end of said leg rest section.

10. The device of claim 1 wherein said pivotal connection between said first and second sets of diagonal braces comprises past dead center joints which function as the means for releasably locking the torso and leq rest sections in the elevated position.

11. The device of claim 1 further comprising a towing mechanism mounted on the underside of said cross braces.

12. The device of claim 11 wherein said towing mechanism comprises a tow handle attached to a tow bar telescoped within a tubular sleeve; and further comprising a locking mechanism for said tow bar.

13. The device of claim 12 wherein said locking mechanism comprises a tow bar release connected to a latch pin which seats in an aperture in said tow bar when in its stored position, and when said tow bar release is actuated, said latch pin is displaced, freeing it from said aperture.

14. The device of claim 13 wherein said tow bar is stopped from being pulled completely out of said tubular sleeve bv said latch pin, said latch pin being engageable in an annular recess adjacent the distal end of said tow bar.

15. The device of claim 14 wherein a conical segment lies immediately adjacent said annular recess in the direction of said tow handle which acts to cam said latch pin outwardly to release said tow bar for inward movement.

16. The device of claim 14 wherein said tow bar has a double swivel joint to permit multidirectional movement of the tow bar when in the fully extended position.

17. The device of claim 1 further comorising a headrest section pivotally connected to said side rails to allow for angled positioning of the patient.

18. The device of claim 17 further comprising extensible handles telescoped within said side rails at the ends thereof adjacent said headrest section.

19. The device of claim 18 wherein each of said handles has a latch button interconnected with a latch pin, wherein said latch pin emerges through any of a plurality of latch holes located on said side rails, wherebly when said latch is depressed, said latch pin recedes into said side rails releasing said handles for movement into an extended position where said handle can be locked in place by allowing said latch oin to emerge through any of said latch holes.

20. A combination stretcher and stairchair comprising:

a main frame having an opposing pair of side rails with spaced apart cross braces extending between said side rails, a torso section pivotally connected to said side rails intermediate their opposite ends, said torso section having opposing side frame members pivotally connected at their inner ends to said side rails, and a crossbar at their outermost ends, a leg rest section having opposing side rail members pivotally connected to the outermost ends of the side rails of said torso section, and a cross brace extending between the side rail members of said leg rest section adjacent their outermost ends, sets of diagonal braces interconnecting said torso section with said main frame for pivotal movement of said torso and leg rest sections from a collapsed position to an elevated position in which said sections form a seat, wherein said diagonal braces comprise at last two sections pivotally joined together by hinge means capable of releasably locking said diagonal braces in the chair position, and a means for releasably locking the sections in the stretcher position, said means comprising a release bar having a plurality of notched brackets dimensioned to interlock with said hinge means provided on said diagonal braces.

21. The device of claim 20 wherein said hinge means includes pins positioned to be engaged by said notched brackets.

* * * * *